United States Patent [19]

Sato

[11] 3,936,249

[45] Feb. 3, 1976

[54] ROTARY COMPRESSOR OF OIL COOLING TYPE WITH APPROPRIATE OIL DISCHARGE CIRCUIT

[75] Inventor: Goro Sato, Atami, Japan

[73] Assignee: Hokuetsu Kogyo Co., Ltd., Japan

[22] Filed: Sept. 24, 1974

[21] Appl. No.: 508,837

[30] Foreign Application Priority Data

Nov. 26, 1973 Japan ..... 48-131739

[52] U.S. Cl. ..... 418/88; 418/99

[51] Int. Cl.[2] ..... F01C 21/04; F04C 29/02; F01C 21/06; F04C 29/04

[58] Field of Search ..... 418/88, 97, 98, 99

[56] References Cited

UNITED STATES PATENTS

| | | | |
|---|---|---|---|
| 2,677,944 | 5/1954 | Ruff | 418/88 X |
| 2,961,151 | 11/1960 | Fobian | 418/88 X |
| 3,168,236 | 2/1965 | Lamberton et al. | 418/88 X |
| 3,191,854 | 6/1965 | Lowler et al. | 418/88 X |
| 3,260,444 | 7/1966 | Williams et al. | 418/88 X |

*Primary Examiner*—C. J. Husar
*Assistant Examiner*—Leonard Smith

[57] ABSTRACT

In rotary compressor of oil cooling type comprising; an unloader, a housing including a rotor chamber therein connected to said unloader, rotors housed within said housing, a reservoir for compressed air and oil connected through a check valve to a discharge port of said chamber and pipes for feeding oil from said reservoir into said chamber, the improvement wherein said rotary compressor further comprises an oil delivery pump is operatively connected to said rotors and an appropriate oil-discharge pipe is provided for delivering the cooling lubricant oil drawn from said port by said pump to said reservoir.

1 Claim, 4 Drawing Figures

ROTARY COMPRESSOR OF OIL COOLING TYPE WITH APPROPRIATE OIL DISCHARGE CIRCUIT

BACKGROUND OF THE INVENTION:

This invention relates to a rotary compressor of oil cooling type.

There have been found various problems such as those mentioned below in connection with known rotary compressors of oil cooling type due to the differences in the physical properties of the cooling lubricant oil and the air to be compressed.

First, since, differently from air, oil cannot be compressed, the composite compression ratio is reduced as the mixture ratio of oil to air increases and as a consequence the compressor is troubled with oil locking and other problems and a large amount of power is consumed.

Second, since oil has viscosity of some thousand times higher than that of air, a larger amount of power is lost when oil and air flow through a complicated pipe line including a large number of pipes and valves at the same speed.

Third, the power loss is increased by the fact that oil has specific gravity of some hundred times larger than that of air, that the liquid resistance of oil is great as compared with that of air, and that liquid resistance in a complicated pipe line is extremely large.

Moreover, in the conventional rotary compressor of oil cooling type, although power can be reduced during fully unloaded operation, it cannot be reduced during operation at an intermediate load i.e., at the intermediate state between fully loaded and unloaded during the capacity-controlling operation of the compressor.

FIG. 1 shows a general view of the conventional type of rotary compressor, which comprises a suction chamber 1 into which air is drawn, an unloader 2 of the suction-closed type connected thereto, a housing 3, and rotors 5 housed within a rotor chamber 4 of said housing. The rotor chamber 4 is communicated through a discharge port 6 with a discharge chamber 7 and said discharge chamber 7 is connected through a port 8 and a check valve 9 to a discharge pipe 10, which is in turn connected to a reservoir 11 for compressed air and oil.

Coaxially connected to the rotors 5 is an oil delivery pump 12 one side of which is connected through a pipe 13, an oil cooler 14 and a pipe 15 to the bottom of the reservoir 11 and the other side of which is connected through a pipe 16 to the rotor chamber 4. Said reservoir 11 is connected through a pipe 17 and a valve 18 to the load.

When the compressor is actuated, air is drawn through the suction chamber 1 and unloader 2 into the rotor chamber 4 where it is compressed. The compressed air is then discharged through the discharge port 6 into the discharge chamber 7 together with the cooling lubricant oil injected by the oil delivery pump 12 into the rotor chamber 4. Said compressed air and cooling lubricant oil force the check valve 9 to open and are then delivered to the reservoir 11 through the port 8.

When the demand of the load for the compressed air decreases, the unloader is actuated to interrupt the introduction of air into the compressor and the check valve 9 is closed due to air pressure in the reservoir 11.

During operation of the compressor, regardless of whether the unloader is actuated or not, the cooling lubricant oil is injected from the reservoir 11 into the rotor chamber 4 by the oil delivery pump 12 through the pipe 15, oil cooler 14 and pipes 13 and 16. A portion of the oil lubricates the bearings of the rotors and is then discharged into the discharge chamber 7 through the discharge port 6.

When, as mentioned above, the unloader is actuated to interrupt the introduction of air into the compressor and close the check valve 9, pressure still remains in the discharge chamber 7 so that a big and uneconomical power loss is caused by the rotation of the compressor when unloaded.

Further, a large amount of oil is delivered for cooling and lubricating parts of the compressor during unloaded operation. This oil collects in the discharge chamber 7 and causes "oil locking" and other bad effects.

FIG. 2 is a general view of a conventional compressor having improvements over the compressor shown in FIG. 1. In this compressor, a pipe 19 from the oil cooler 14 is on the one hand connected through a pipe 20, a selector valve 21 and a pipe 22 to the oil delivery pump 12, and, on the other hand, through a pipe 23, an orifice 24 and a pipe 25 to the rotor chamber 4.

The oil delivery pump 12 is connected through a pipe 26 and a selector valve 27 to the pipe 25, said selector valve 27 is connected to the bottom of the reservoir 11 through a pipe 28. An intermediate point between the discharge port 6 and the check valve 9 is connected to the selector valve 21 through a pipe 29.

When the compressor is actuated, oil is introduced from the reservoir 11 into the oil delivery pump 12 through the pipe 15, oil cooler 14, pipes 19 and 20, selector valve 21 and pipe 22. Oil discharge from the oil delivery pump 12 is injected into the rotor chamber 4 through the pipe 26, selector valve 27 and pipe 25 to cool and lubricate the bearings and the rotor chamber 4.

When the demand for compressed air decreases, the unloader 2 is actuated to interrupt the introduction of air into the compressor and close the check valve 9 and the selector valve 21 and 27 are then actuated to block communication between the pipes 22 and 20 and to maintain communication between the pipes 22 and 29 and to block communication between the pipes 26 and 25 and to maintain communication between the pipes 26 and 28. Thus, the compressed air remaining in the pipe 10 and the cooling lubricant oil discharged into the pipe are withdrawn, through the pipe 29, selector valve 21 and pipe 22 by the oil delivery pump 12. Air and oil discharged from the oil pump 12 are delivered through the pipe 26, selector valve 27 and pipe 28 into the reservoir 11. Thus, the pressure at the discharge port 6 and in the pipe 10 is reduced to minimize the power loss during the unloaded operation so that power saving is possible.

During such unloaded operation, the supply of cooling lubricant oil to the compressor is accomplished by the pressure in the reservoir 11. Oil is delivered through the pipe 15, oil cooler 14, pipes 19 and 23, orifice 24 and pipe 25 into the rotor chamber 4. In this case, since the oil supply need not be as great as in loaded operation, the flow rate of oil may be controlled by properly selecting the configuration and size of the orifice 24.

In this system, the network of pipe lines becomes complicated due to the adoption of the selector valves 21 and 27. Therefore fluid resistance becomes large and the cost of production may also increase. If these valves should fail to operate not only will it become impossible to save power but also the resulting insufficiency of oil reaching the compressor may cause overheating or even fire. Therefore it may be said that this system is not sufficiently safe or reliable for practical application. Furthermore, although power saving may be possible during completely unloaded operation, no saving can be attained during capacity-controlling operation of the compressor at the intermediate state between the fully loaded and unloaded states.

SUMMARY OF THE INVENTION

An object of the invention is to provide a rotary compressor of oil cooling type capable of eliminating such defects wherein the pipe line network is simplified without employing special selector valves, the cost of production is lowered, the possibility of fire or overheating is eliminated, power can be saved during capacity-controlling operation at the intermediate state between the fully loaded and unloaded states and oil-locking and machine breakdown are prevented.

The rotary compressor of oil cooling type according to the present invention comprises an unloader, a housing including a rotor chamber therein and connected to said unloader, rotors housed within said housing, a reservoir for compressed air and oil connected through a check valve to a discharge port of said rotor chamber, and pipes for feeding oil from said reservoir into said rotor chamber, the improvement wherein said rotary compressor further comprises an oil delivery pump is operatively connected to said rotors and an appropriate oil discharge pipe for delivering cooling lubricant oil drawn from said discharge port to said reservoir by said oil delivery pump.

Another object of the present invention is to provide a rotary compressor of oil cooling type wherein oil of high density within the discharge chamber may efficiently extracted.

The rotary compressor according to the present invention comprises an opening communicating said discharge port with said appropriate oil discharge pipe which opening is located at the lower level than the port communicating said discharge port with said check valve.

DESCRIPTION OF THE PREFERRED EMBODIMENT

Now a preferred embodiment of the present invention will be described with reference to the drawings.

Figure 1:
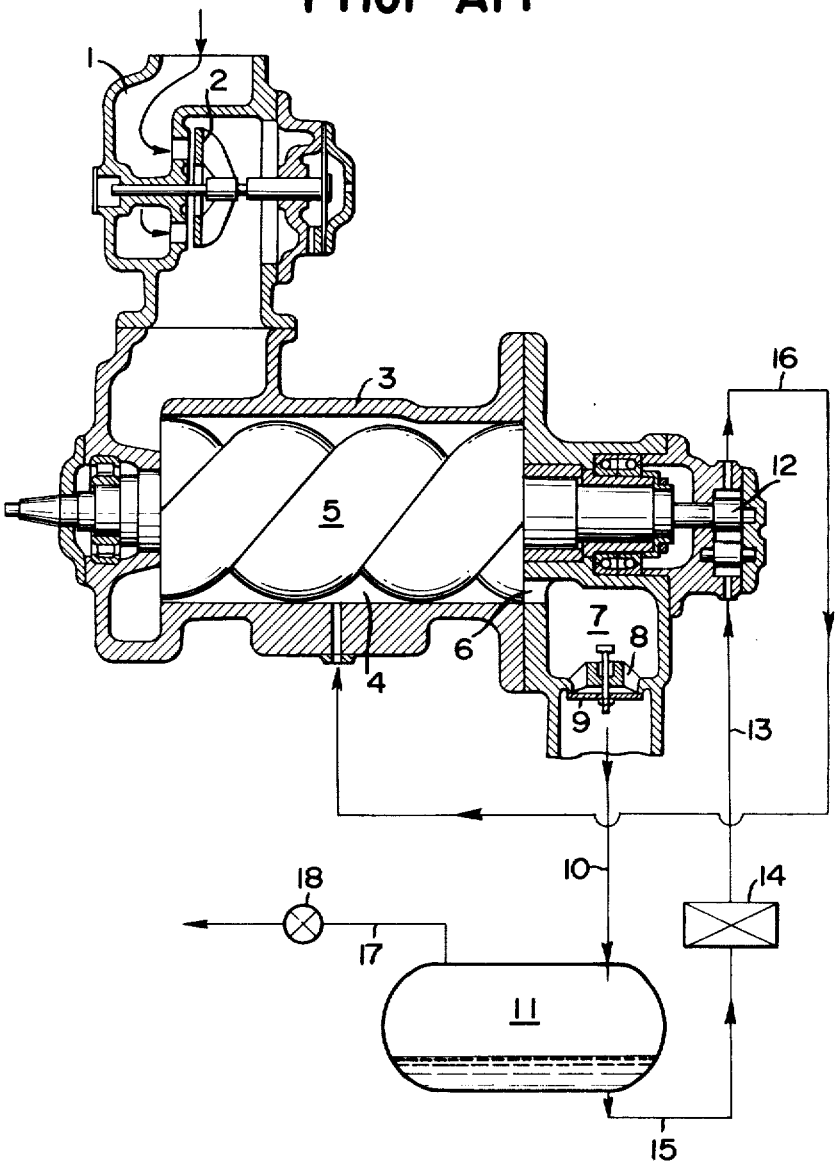
FIG. 1 Prior Art
Figure 2:
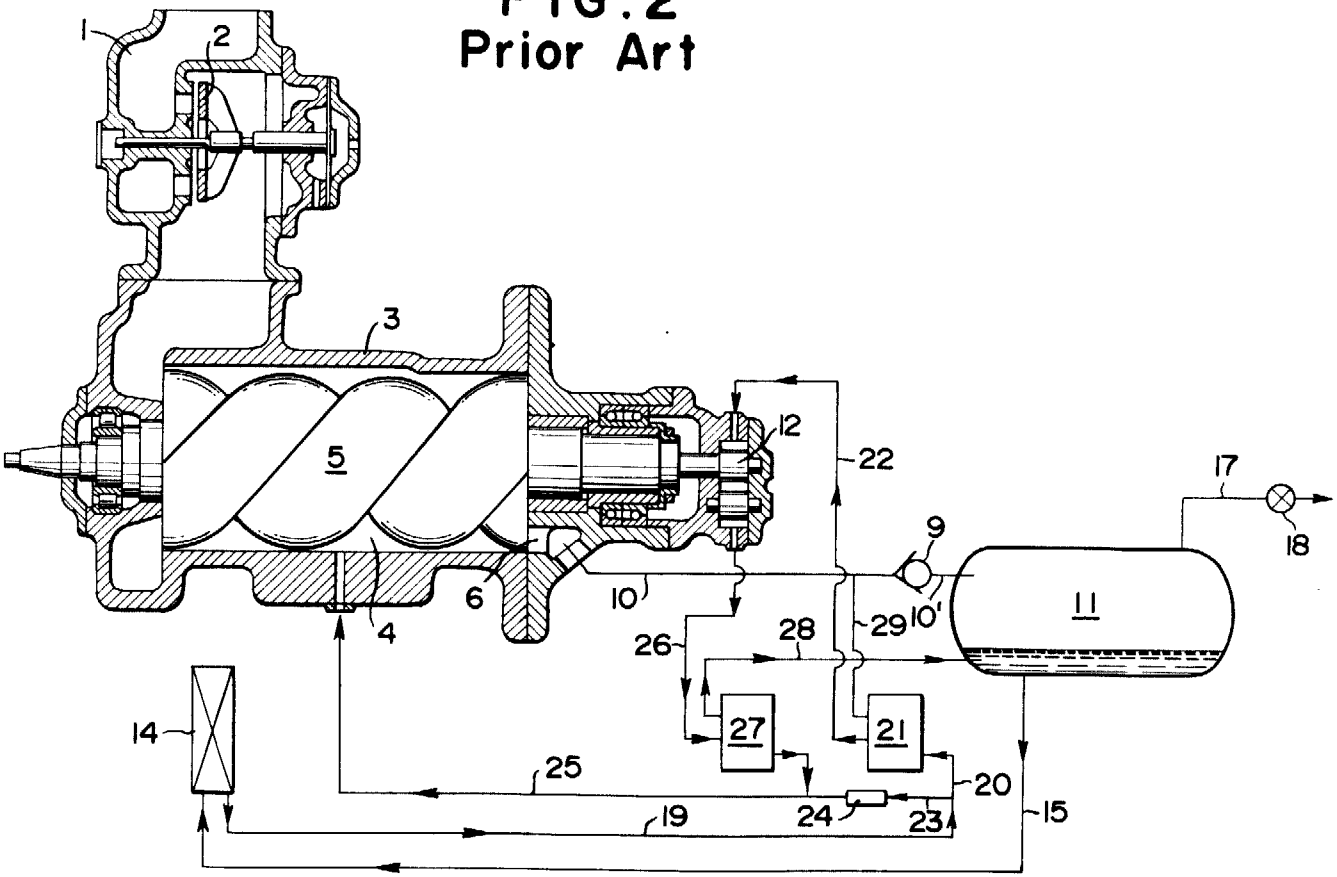
FIG. 2 Prior Art
Figure 3:
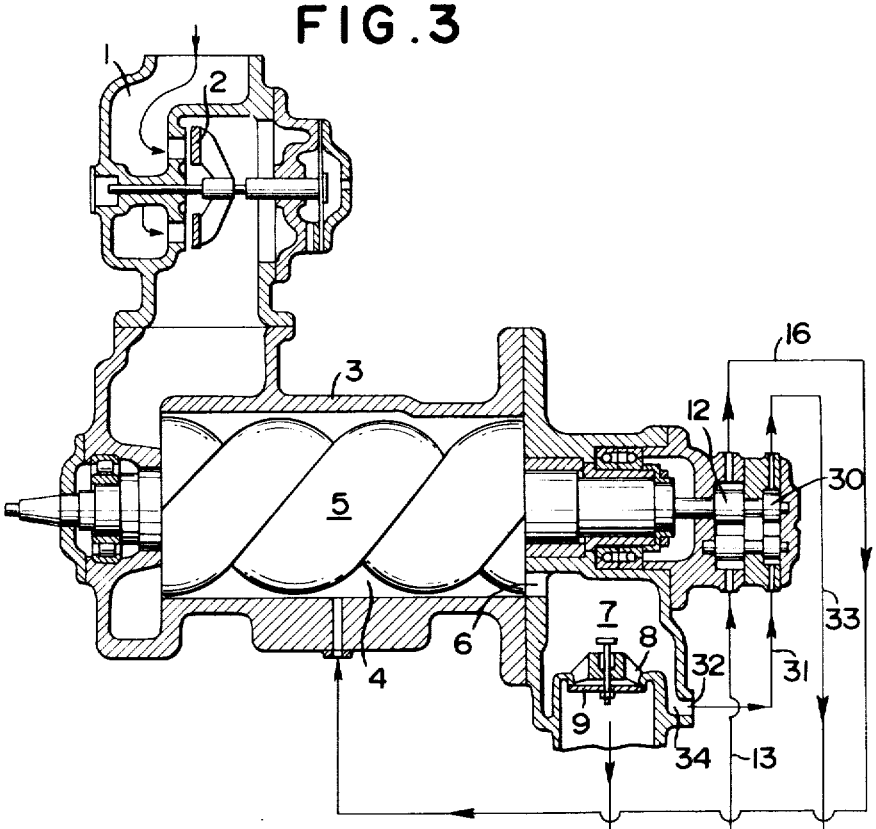
Figure 4:
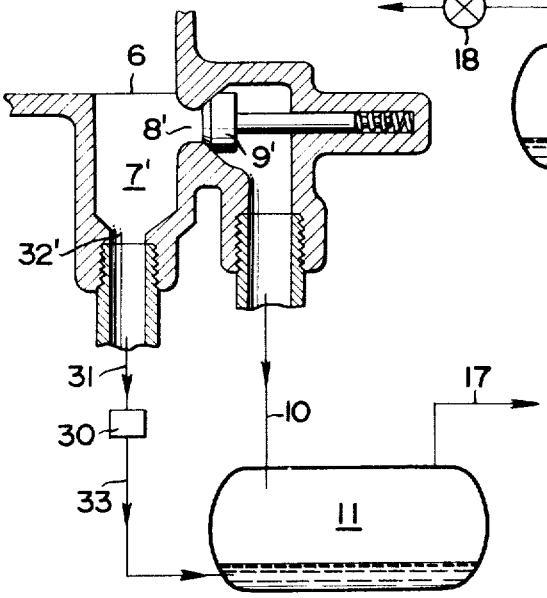

FIG. 3 is a vertical section of an embodiment of the rotary compressor according to the present invention; and FIG. 4 shows the discharge chamber of another embodiment.

In FIG. 3, the rotary compressor comprises a suction chamber 1, an unloader 2 of suction-closed type connected to said suction chamber, a housing 3, and rotors 5 housed within a rotor chamber 4 of said housing. The rotor chamber 4 is communicated through a discharge port 6 with a discharge chamber 7 which is connected through a port 8 and a check valve 9 to a discharge pipe 10. Said pipe 10 is in turn connected to a reservoir 11 for compressed air and oil. Coaxially connected to the rotor 5 is an oil delivery pump 12 which is on the one side connected through a pipe 13, an oil cooler 14 and a pipe 15 to the bottom of the reservoir 11 and is on the other side connected through a pipe 16 to the rotor chamber 4. The reservoir 11 is connected through a pipe 17 and a check valve 18 to the load.

Another oil delivery pump 30 is coaxially connected with said oil pump 12. Said second pump 30 is on the one side connected through a pipe 31 to another opening 32 provided in discharge chamber 7 and is on the other side connected through a pipe 33 to the reservoir 11.

The opening 32 is located at the lowest portions 34 in the discharge chamber 7 and is considerably lower than the port 8.

When the compressor is actuated, air is introduced through the suction chamber 1 and the unloader 2 into the rotor chamber 4 where air is to be compressed. The compressed air is discharged through the discharge port 6 into the discharge chamber 7 together with the cooling lubricant oil injected into the rotor chamber 4 by the oil delivery pump 12. The compressed air and cooling lubricant oil pass through the port 8, force the check valve 9 to open, and then are delivered through the pipe 10 to the reservoir 11. If desired, the oil delivery pump 12 may be deleted by connecting the pipes 16 and 13 directly so that oil may be injected into the rotor chamber 4 by the pressure in the reservoir 11. In this case the amount of injected oil becomes to be somewhat unstable.

When the demand for compressed air decreases, the unloader is actuated to interrupt the introduction of air into the compressor and the check valve 9 is closed by the compressed air in the reservoir 11. During operation of the compressor, regardless of whether the unloader is actuated or not, the cooling lubricant oil is injected from the reservoir 11 into the rotor chamber 4 by the oil delivery pump 12 through the pipe 15, oil cooler 14 and pipes 13 and 16. A part of the cooling lubricant oil will lubricate the bearings of rotors and then be discharged through the discharge port 6 into the discharge chamber 7.

The cooling lubricant oil collected in the discharge chamber 7 is drawn through the second opening 32 in the discharge chamber 7 and the pipe 31 by the second pump 30 and then is collected through the pipe 33 in the reservoir 11. Thus pressure in the discharge chamber 7 is decreased, the power consumption of the compressor being thereby reduced.

Since a selector valve is not used in the compressor according to this invention, there is no danger of fire or overheating and oil locking caused by accumulation of oil in the discharge chamber may also be prevented. Furthermore, since said pump 30 is always actuated at the time the compressor rotates, power saving is possible not only during fully unloaded operation, but also during partially loaded operation or during controlled-capacity operation in the intermediate state between the fully unloaded and fully loaded operation.

The opening 32 is located at the lowest portion 34 of the discharge chamber 7 and is considerably lower than the port 8. Thus the delivery pump 30 scarcely draws air from the discharge chamber 7. Power required for the pump 30 is extremely small and negligible.

In another embodiment shown in FIG. 4, a discharge chamber 7' is provided with a port 8' and a check valve 9' at one side of its upper portion, an opening 32' being located at the lowest portion of the discharge chamber 7'.

What is claimed is:

1. In a rotary compressor of the oil cooling type comprising: an unloader, a housing including a rotor chamber therein and connected to said unloader, rotors housed within said housing, said rotor chamber having a discharge port from which an oil-air mixture is discharged under pressure, and a discharge chamber which is in communication with said discharge port, a check valve with a further port provided in said discharge chamber, discharge conduit means communicated with said discharge chamber through said check valve and said further port, a reservoir for compressed air and oil connected at an air space formed therein to said discharge pipe, and second conduit means communicated with said reservoir at the oil space therein and said rotor chamber, said discharge chamber having a second opening which is positioned at a lower portion than said further port, whereby oil is separated from the oil-air mixture and collected in said lower portion, an oil discharge pump drivably connected to one of said rotors, said oil discharge pump being connected at one side to said second opening through third conduit means and at the other side to said reservoir through fourth conduit means whereby the oil is delivered from the discharge chamber to the reservoir continuously during operation of the compressor.

* * * * *